US005513451A

United States Patent [19]

Kataoka et al.

[11] Patent Number: 5,513,451

[45] Date of Patent: May 7, 1996

[54] SPIKE FOR TRACK RACE SHOES

[75] Inventors: Akira Kataoka; Morio Nakagawa; Katsuhisa Ohno, all of Kobe, Japan

[73] Assignee: ASICS Corporation, Japan

[21] Appl. No.: 427,978

[22] Filed: Apr. 21, 1995

Related U.S. Application Data

[63] Continuation of Ser. No. 161,062, Dec. 3, 1993, abandoned, which is a continuation of Ser. No. 905,869, Jun. 30, 1992, abandoned.

[30] Foreign Application Priority Data

| | | | |
|---|---|---|---|
| Feb. 7, 1992 | [JP] | Japan | 4-004333 U |
| May 9, 1992 | [JP] | Japan | 4-13552 |
| May 11, 1992 | [JP] | Japan | 4-13725 |
| May 11, 1992 | [JP] | Japan | 4-13726 |
| May 11, 1992 | [JP] | Japan | 4-13727 |
| May 11, 1992 | [JP] | Japan | 4-13728 |

[51] Int. Cl.[6] ..... A43B 5/00; A43C 15/00

[52] U.S. Cl. ..... 36/129; 36/134; 36/67 R; 36/67 D

[58] Field of Search ..... 36/67 R, 67 A, 36/67 B, 67 D, 129, 132, 134

[56] References Cited

U.S. PATENT DOCUMENTS

| | | | |
|---|---|---|---|
| 122,587 | 1/1872 | Ellis | 36/134 |
| 1,867,219 | 7/1932 | Harper | 36/134 |
| 2,061,963 | 11/1936 | Gabriele | 36/67 B |
| 2,095,095 | 10/1937 | Howard | 36/134 |
| 2,179,942 | 11/1939 | Lyne | 36/134 |
| 2,367,736 | 1/1945 | Parsons | 36/67 D |
| 3,082,549 | 3/1963 | Dolceamore | 36/134 |
| 3,624,934 | 12/1971 | Bernier et al. | 36/67 A |
| 4,527,344 | 7/1985 | Mozena | 36/134 |
| 4,590,693 | 5/1986 | Kawashima et al. | 36/67 D |

FOREIGN PATENT DOCUMENTS

| | | | |
|---|---|---|---|
| 2328642 | 12/1972 | Germany | 36/129 |

*Primary Examiner*—Paul T. Sewell
*Assistant Examiner*—Marie Denise Patterson
*Attorney, Agent, or Firm*—Nixon & Vanderhye

[57] ABSTRACT

A spike is mountable onto the sole of a spiked track shoe which allows a runner to develop maximum propulsion against the field surface. The spike is removably attachable to the track shoe and includes an elongate support plate having at one end thereof a connection hole for connection with the shoe, and a spike portion disposed at the other end. The spike portion is disposed at an obtuse angle (i.e., greater than a right angle relative to the support plate). The spike is made of metal or of synthetic resin, and the spike portion may include one or more than one spike parts. The angle between the spike portion and the support plate is preferably between 95 and 130 degrees, and more preferably between 105 and 120 degrees. The spike portion is preferably convergent towards the tip thereof, for example in the shape of a cone. The spike portion may, however, also be suitably formed into a cylindrical shape, or in a stepped cylindrical shape.

14 Claims, 6 Drawing Sheets

SPIKE FOR TRACK RACE SHOES

This is a continuation of parent application Ser. No. 08/161,062 filed Dec. 3, 1993 (now abandoned), which in turn is a continuation of Ser. No. 07/905,869, filed Jun. 30, 1992 (now abandoned).

BACKGROUND OF THE INVENTION

1. Field of the Invention

The present invention relates to an improvement in spiked track shoes, especially those used for short distance races. The invention is directed to a spike which enables a runner to exert maximum propulsion against the field.

2. Description of the Related Art

Conventionally known spikes are threadably, and hence removably, attached through a thread spike to a washer buried in a rigid sheet made from a plastics material, for example nylon. Most of the washers employed with conventional spikes are disc-shaped to provide effective support for the spikes. The spike is then naturally mounted at the center of disk-shaped washer.

A major purpose of spikes attached to spiked track shoes is to obtain the maximum field holding force during running actions through landing to kicking while minimizing energy loss. Specifically, it is not too much to say that the technical point of spikes for track is to make them functionally effective through landing to kicking in short distance races where runners compete for 0.01 second intervals. Ideally, the spike is set on the sole as close to the tip end of the shoe toes as is possible to obtain the maximum propulsion of the spike from landing (where upon which the spike is first in contact with the field) through kicking, (where the spike finally leaves the field).

However, since conventional spikes are mounted on disc-shaped washers, the spikes have to be recessed from the tip end of the shoe toes at least by the radius dimension of the washer so as to provide support strength for the spike. Therefore, conventional spikes cannot be mounted at the ideal position as described. In addition, conventional spikes are usually mounted at an angle normal to the plane of the contact sole, which results in less than maximum field holding force of the spike during use from landing to kicking.

SUMMARY OF THE INVENTION

It is, therefore, an object of the present invention to provide a spike which may be set on the sole as close to the tip end of the shoe toes as is possible and which allows a runner to achieve maximum propulsion therefrom.

The present invention is embodied by a spike removably attachable to a shoe used for track races which includes an elongate support plate having at one end thereof a connection means for connection with the shoe, and a spike portion disposed at the other end of the support plate. The spike portion is, moveover, disposed at an obtuse angle, i.e., an angle greater than a right angle relative to the support plate.

According to the present invention, the spike portion is arranged to project outwardly from the other end of support plate, so that the spike may be mounted on the shoe sole such that the spike portion is positioned at the tip end of shoe toes on the sole. Further, since the spike portion projects downward at an angle greater than 90 degrees with respect to the plane of support plate, the maximum field holding force may be fully utilized by a runner from landing to kicking.

The angle between the spike portion and the support plate is preferably between 95 and 130 degrees, and more preferably between 105 and 120 degrees.

The connection means may be one hole or a plurality of holes, through which the spike is attached to the shoe, for example by one or more screws.

The spike portion may be formed as a single part or may be formed of a number of parts, and is preferably convergent towards the tip thereof. The geometry of the spike portion may preferably be in the form of a cone, cylinder, or stepped cylinder. The stepped cylinder form of the spike portion may have a plurality of steps.

The spike may be made of metal such as steel, aluminum alloy, and titanium, or may be made of synthetic resin, such as nylon.

The support plate may be narrowed in the middle portion so as to reduce weight, or may be thick in the middle portion to increase the strength.

Further objects and advantages of the present invention will be apparent from the following description of the preferred embodiments of the invention as illustrated in the accompanying drawings.

DESCRIPTION OF THE PREFERRED EMBODIMENTS

Embodiments of the spike according to the present invention will be explained below in comparison with a conventional spike with reference to FIGS. 16, 17*a*, and 17*b*.

Figure 17A:
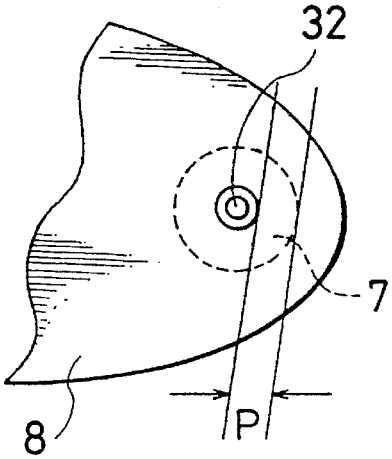
Fig. 17a (PRIOR ART)
FIG. 17*a* a is a schematic plan view to show a major part of shoe on which the conventional spike is mounted.
Figure 17B:
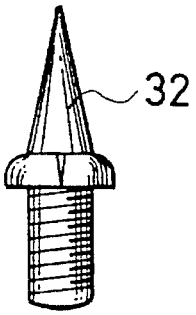
Fig. 17b (PRIOR ART)
FIG. 17*b* is a side view of the spike of FIG. 17*a*.

As shown in FIG. 17*a*, the conventional spike is removably attached to a washer 7 preliminarily buried in a rigid sheet 8 of plastics, such as nylon, through threads of the spike 32 as detailed in FIG. 17*b*. The washer 7 is disk-shaped to effectively support the spike 32. As a result, the spike 32 is naturally mounted at the center of the disk-shaped washer 7.

In the conventional arrangement, since the washer 7, onto which the spike 32 is mounted, is disk-shaped, the spike 32 is recessed from the tip end of toes by a radius P of the washer 7. While the support strength for the spike 32 is assured by such an arrangement, the spike 32 is not mounted at an ideal position, which is the closest position to the tip end of the shoe toes. Further, the spike 32 is mounted normally to the contact sole plane.

Figure 16:
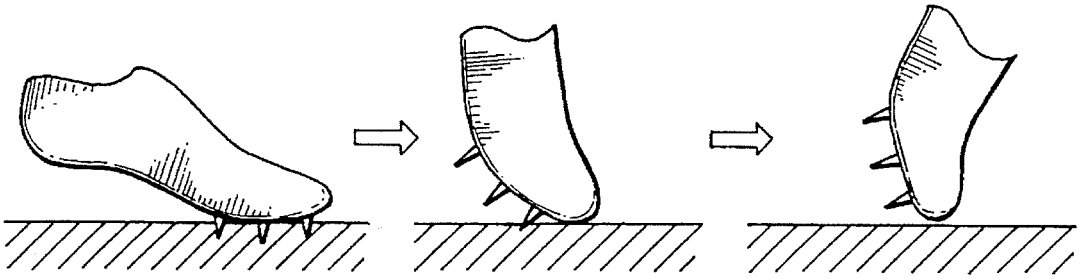
Fig. 16 (PRIOR ART)
FIG. 16 is a drawing to illustrate an example of use of conventional spike.

FIG. 16 shows the relationship between the spike and the field surface during running of a runner who actually wears shoes equipped with such conventional spikes.

As seen from FIG. 16, the front edge of the shoe becomes upright on the field surface upon kicking, that is at the moment just before the spike leaves the field surface. Thus, the spike inside the toe ends is raised from the surface, and as a result, is functionally ineffective. In this state, the spike cannot hold the field surface at the moment when the runner performs a final kick backward with his foot, thereby greatly reducing the propulsive energy of the spike.

Embodiments of spike according to the present invention are next explained with reference to the accompanying drawings.

Figure 1:
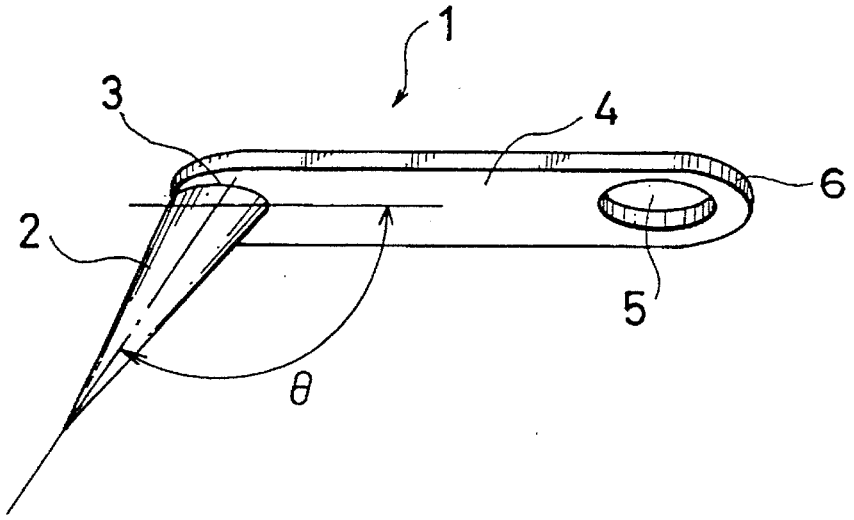
FIG. 1 is a perspective view to show a first embodiment of spike according to the present invention.
Figure 2:
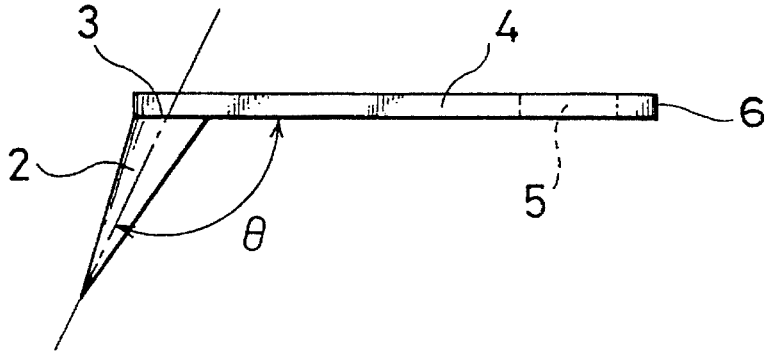
FIG. 2 is a side view of the spike as shown in FIG. 1.

FIGS. 1 and 2 show a first embodiment of spike according to the present invention.

A spike body 1 of the first embodiment includes a spike portion 2 and a support plate 4 integrally extended rearwardly from a base end 3 of the spike portion 2, as shown in FIG. 1. A connection hole 5 is at a rear end 6 in the support plate 4 to connect the spike body 1 to the sole of shoe. The spike portion 2 is further inclined forwardly from a normal angle to the horizontal plane of the support plate 4 as shown in FIG. 2. The spike angle θ is preferably between 95 and 130 degrees, and ideally between 105 and 120 degrees.

The spike body 1 may be made for example of steel, of a light-weight and durable metal such as an aluminum alloy titanium, and the like or of a synthetic resin, such as nylon.

Figure 3:
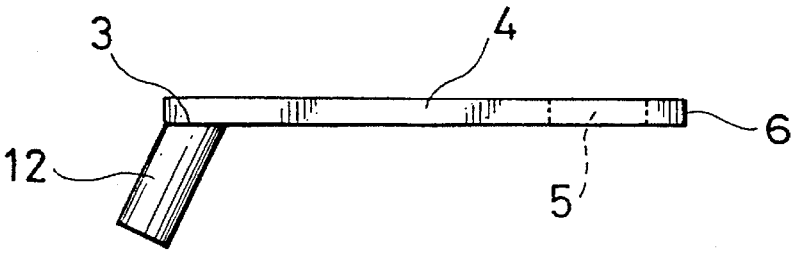
FIG. 3 is a side view to show a modification of spike of the first embodiment.
Figure 4:
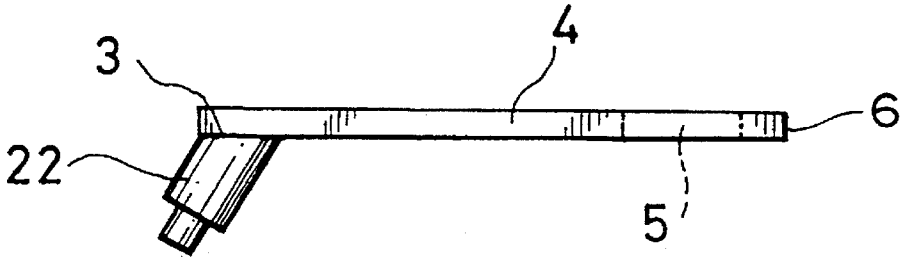
FIG. 4 is a side view to show another modification of spike of the first embodiment.

FIGS. 3 and 4 show modifications of the spike portion 2 of the first embodiment. Since there is only a difference in shape of the spike portion between the first embodiment and its modifications shown in FIGS. 3 and 4, portions of the same shape in the modifications have been given the same reference numerals as in the first embodiment, and an explanation with respect to such structure has been omitted. While FIG. 2 shows the spike portion 2 being conically-shaped, FIG. 3 shows a modification having a spike portion 12 which is cylindrically-shaped, and FIG. 4 show another modification having a spike portion 22 shaped in the form of a stepped cylinder. The spike portion 22 having a stepped cylinder shape may have a single step as shown in FIG. 4 or a plurality of steps. The shape of spike portions 2, 12, 22 is not limited to those described, provided they satisfy the condition of the spike angle of θ. Thus, the spike portions 2, 12, 22 may be properly chosen to match the paving material of the field against which the spike is used. Since the normal load is not so great at the tip of the spike portion, the spike portion is preferably convergent towards its tip considering penetration of spike portion into the track paving material. The height of the spike portions 2, 12, 22 is preferably between 5 and 9 mm.

Figure 5:
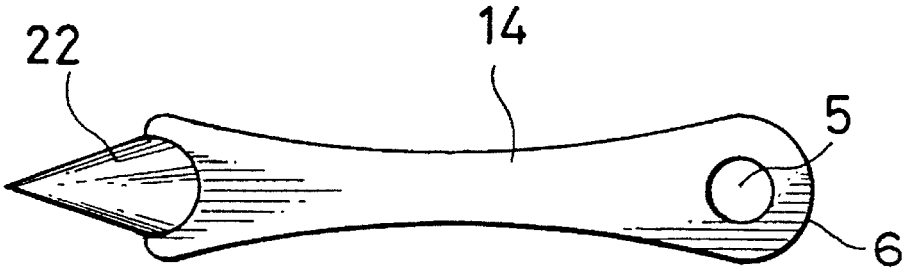
FIG. 5 is a plan view to show a modification of support plate of spike of the first embodiment.
Figure 6:
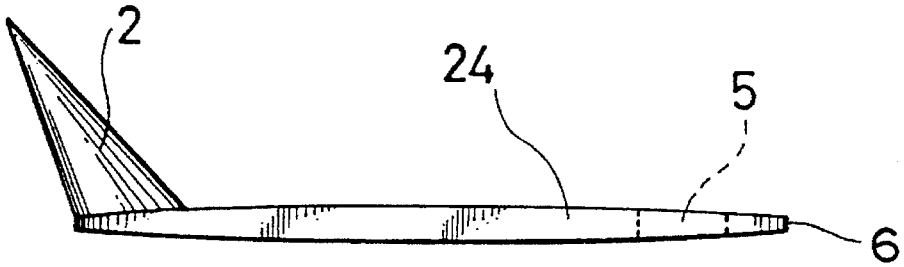
FIG. 6 is a side view to show another modification of support plate of spike of the first embodiment.

FIGS. 5 and 6 show modifications of the support plate 4 of the spike according to the first embodiment. In the modification shown in FIG. 5, the support plate 14 is narrower in the middle portion in the plan view so as to achieve weight reduction as well providing as the necessary strength for the spike body. FIG. 6 is a side view to show another modification of spike, in which the support plate 24 is slightly thicker in the middle to increase strength. The other structures of these modifications are same as in the first embodiment described above. The shape of the support plates 4, 14, 24 is of course not limited to those shown, but may be freely determined considering weight reduction and the durability of the spike body. The length of the support plates 4, 14, 24 is between about 10 and 40 mm from the base end 3 to the rear end 6. The length of the support plates 4, 14, 24 may be set within a range in which a sufficient connection force is assured for landing pressure of the runner when the spike is mounted on the sole of shoe, and in which the light-weight property is maintained.

Figure 13:
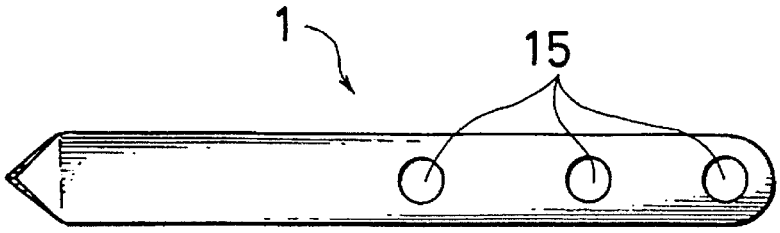
FIG. 13 is a plan view to show a modification of connection hole part of spike according to the present invention.
Figure 14:
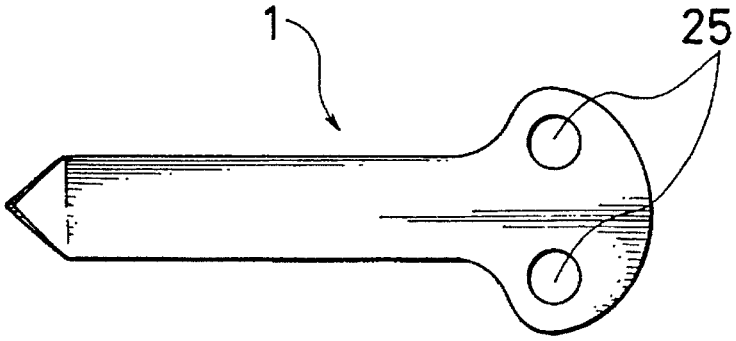
FIG. 14 is a plan view to show another modification of connection hole part of spike according to the present invention.

The connection hole 5 is provided in the support plates 4, 14, 24 to connect the spike to the sole of shoe. A single connection hole 5 may be provided as shown in FIGS. 1–6, or a plurality of holes 15 and 25 may be provided as shown in FIGS. 13 and 14, respectively. A plurality of connection holes may be arranged along the longitudinal center line of support plate 4, 14, or 24, or in a direction perpendicular to the longitudinal center line of the support plate 4, 14, 24. For example, FIG. 13 shows a modification with three longitudinal connection holes 15, and FIG. 14 another modification with two transverse connection holes 25. By the plural connection holes 15, 25, the connection force of spike may be advantageously further increased when the spike is mounted on the shoe sole through the connection holes 15, 25.

Figure 7:
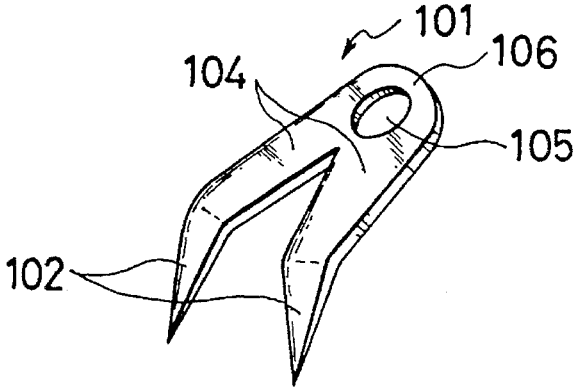
FIG. 7 is a perspective view to show a second embodiment of spike according to the present invention.
Figure 8:
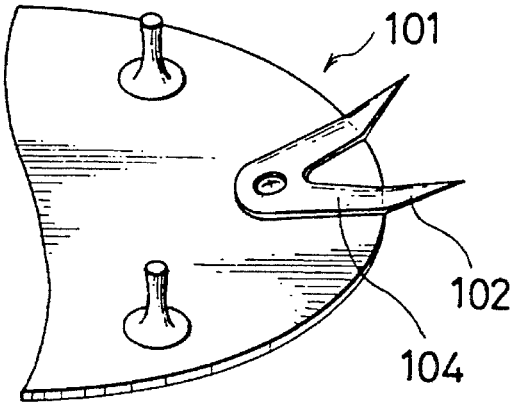
FIG. 8 is a schematic plan view to show a major part of shoe on which the spike of FIG. 7 is mounted.

FIG. 7 shows a second embodiment of a spike 101 in which a support plate 104 is separated into two branches with respective triangular plate-shaped spike portions 102 on respective ends thereof. FIG. 8 shows the spike 101 of FIG. 7 attached to the front end of a shoe. The support plate 104 of spike 101 may have three branches or four branches as well as the two separate branches as shown. According to such arrangement, the field holding force of the spike 101 may be advantageously increased, which is the major purpose of the spike even, though the light-weight property of spike 101 is comprised.

FIGS. 9–12 show modifications of the second embodiment of the spike shown in FIG. 7.

In the modifications, the support plate 104 is separated into two branches 104*a*, 104*b*, which are bent upwardly at 104*a*' and 104*b*', respectively, relative to the plane of the support plate 104. The branches 104*a*, 104*b* each include spike portions 112, 122, 132 or 142 provided at respective tips. The spikes shown in FIGS. 9–12 are same as the spike 101 of the second embodiment as shown in FIG. 7, and thus similar structures have been given the same reference numerals, and explanations related to such structures omitted. The modifications are, however, different in the shape of spike portions as compared to the second embodiment of FIG. 7.

Figure 9:
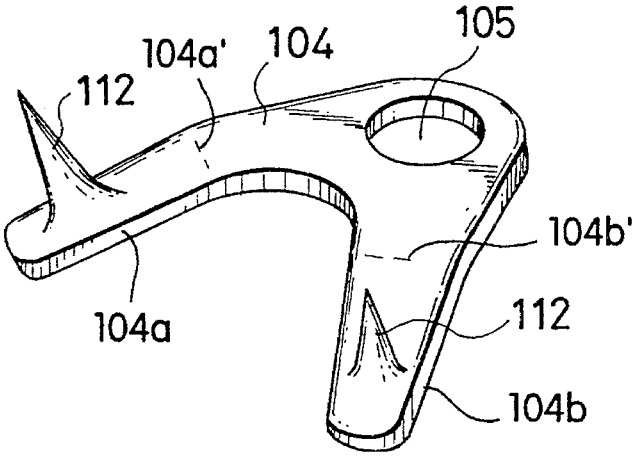
FIG. 9 is a perspective view to show a modification of spike of the second embodiment.
Figure 10:
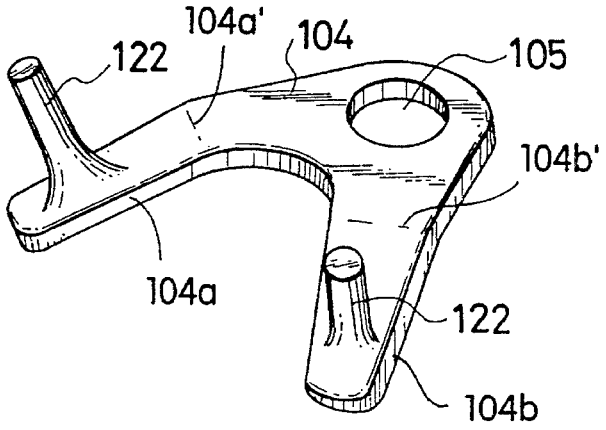
FIG. 10 is a perspective view to show another modification of spike of the second embodiment.
Figure 11:
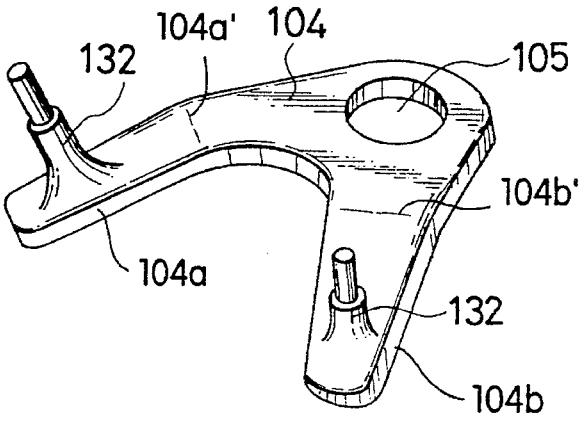
FIG. 11 is a perspective view to show still another modification of spike of the second embodiment.
Figure 12:
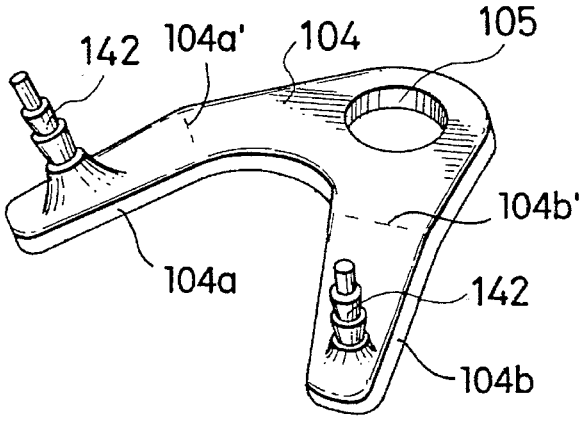
FIG. 12 is a perspective view to show a further modification of spike of the second embodiment.

In this regard, the two spike portions 112 in FIG. 9 are conically-shaped, while spike portions 122 in FIG. 10 are cylindrically shaped. Furthermore, spike portions 132 in FIG. 11 are in the form of a single stepped cylinder, while in still another modification shown in FIG. 11, the spike portions 142 are in the form of a multiple (three) stepped cylinder.

The separation of support plate and the number of spike portions may be more than two.

Also, the number of steps of the stepped cylinder may be arbitrarily determined.

Further, a plurality of connection holes may be provided in the above modifications of FIGS. 9–12, as shown in FIGS. 13 and 14.

The spike of the present invention as explained has excellent advantages over conventional spikes.

The advantages of the present invention will be explained in comparison with the conventional spike as shown in FIG. 16. Although the conventional spike is set as close to the tip end of the shoe sole as possible, the spike must be mounted inside the tip by the radius P of disk-shaped washer 7. In such a state, the conventional spike is inside the tip end of the shoe toes and, as a result becomes upright to the field surface upon a runner kicking during stride (e.g., momentarily) before the runner's foot leaves the field surface), so that the spike inside the toe end of shoe is raised from the field surface. Therefore, the spike is functionally ineffective at that final moment in the runner's stride. In such a state, the spike cannot hold the field surface at the moment of the runner's final kick, in which the foot is still kicking backward, thereby greatly losing the propulsive energy of spike.

Figure 15:
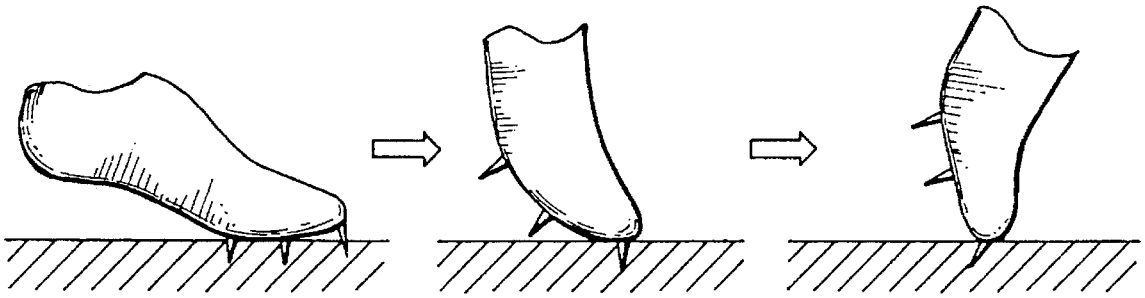
FIG. 15 is a drawing to illustrate an example of use of spike according to the present invention.

In contrast, according to the present invention, the spike portion is integrally formed with the support plate extending from the base end thereof, so that the spike portion may be mounted at a position on the sole close to the tip end of the shoe toes. Further, since the spike portion projects outwardly from the support plate at an angle between 95 and 130 degrees with respect to the horizontal plane of the support plate, i.e. forwardly relative to a normal line to the horizontal plane, the spike fully pierces the field surface to hold it at the final moment of a runner's kick as shown in FIG. 15. As a result, the spike according to this invention is functionally effective to obtain the maximum propulsion up to the moment it leaves the field surface.

Therefore, the present invention is extremely practically valuable in applications for spiked track shoes, especially track shoes used for short distance races.

Many widely different embodiments of the present invention may be constructed without departing from the spirit and scope of the present invention. It should be understood that the present invention is not limited to the specific embodiments described in the specification, except as defined in the appended claims.

What is claimed is:

1. A spiked track shoe having (i) a toe portion, (ii) a shoe sole defining a forward tip portion near said toe portion, and (iii) a spike connected to said sole, wherein said spike comprises:

a planar supporting plate having rearward and forward ends, said supporting plate including at least two elongate branches which are joined integrally to, and extend forwardly of, said forward end of said supporting plate, each of said two branches being bent upwardly at said forward end of said supporting plate;

at least one connecting hole disposed at said rearward end of said elongated supporting plate;

a spike connector connecting said supporting plate to said track shoe sole through said connecting hole; and spike portions respectively positioned on said two elongate branches at an angle which is greater than a right angle relative to said planar supporting plate; wherein each of said two elongate branches has a length dimension between forwardly of said forward end of said supporting plate sufficient such that said each said branch extends forwardly thereof to said tip portion of said sole so that said spike portion positioned on each of said branches is disposed at said toe portion of said shoe and extends forwardly thereof to thereby allow said spike portion to fully pierce a field surface upon which the track shoe is used until a final moment of a runner's kick; and wherein said supporting plate and said at least two branches are unconnected to said sole forwardly of said at least one connecting hole.

2. A spike a track shoe according to claim 1, wherein said angle is between 95 and 130 degrees.

3. A spiked track shoe according to claim 1, wherein said angle is between 105 and 120 degrees.

4. A spiked track shoe according to claim 1, wherein said spike portion is terminal end thereof.

5. A spiked track shoe according to claim 1, wherein said spike portion is conical.

6. A spiked track shoe according to claim 1, wherein said spike portion is cylindrical.

7. A spiked track shoe according to claim 1, wherein said spike portion is in the shape of a stepped cylinder. spike portion a stepped cylinder.

8. A spiked track shoe according to claim 7, wherein said stepped cylinder has a plurality of steps.

9. A spiked track shoe according to claim 1, wherein said two spike portions are conical.

10. A spiked track shoe according to claim 1, wherein said two spike portions are each cylindrical.

11. A spiked track shoe according to claim 1, wherein said two spike portions each have the form of a stepped cylinder.

12. A spiked tracked shoe according to claim 11, wherein each of said stepped cylinder has a plurality of steps.

13. A spiked track shoe according to claim 1, wherein said spike is made of metal.

14. A spiked track shoe according to claim 1, wherein said spike is of synthetic resin.

* * * * *